United States Patent [19]

Kramer

[11] Patent Number: 4,626,112

[45] Date of Patent: Dec. 2, 1986

[54] PROPELLER BEARING

[75] Inventor: James H. Kramer, Akron, Ohio

[73] Assignee: The B.F. Goodrich Company, Akron, Ohio

[21] Appl. No.: 574,314

[22] Filed: Jan. 27, 1984

[51] Int. Cl.[4] ..... F01D 5/00; F16C 33/20; F16D 7/02; F16D 3/64

[52] U.S. Cl. ..... 384/300; 384/296; 384/908; 416/134 R; 416/169 R; 464/30; 464/89

[58] Field of Search ..... 384/124, 222, 280, 300, 384/296, 93, 276, 908; 308/1 A, DIG. 8; 416/134 R, 169 C; 464/30, 89, 180, 87, 90, 903, 911

[56] References Cited

U.S. PATENT DOCUMENTS

| | | | |
|---|---|---|---|
| 2,125,270 | 8/1938 | Conover | 464/89 X |
| 2,962,312 | 11/1960 | Wanner | 464/89 X |
| 3,011,219 | 12/1961 | Williams | 384/300 X |
| 3,194,614 | 7/1965 | Thomas | 384/222 |
| 3,230,739 | 1/1966 | Stewart | 464/89 X |
| 4,041,730 | 8/1977 | Kress | 464/89 X |

*Primary Examiner*—Stuart S. Levy
*Assistant Examiner*—Lynn M. Sohacki
*Attorney, Agent, or Firm*—Joseph Januszkiewicz

[57] ABSTRACT

A bearing assembly for use with a marine propeller wherein a rigid bushing is adapted to be connected to a drive shaft for rotation therewith, while an annular elastomeric ring in radial compression has its inner surface bonded to such bushing. The outer surface of such deformed elastomeric ring is in frictional engagement with an anti-functional cylindrical member which in turn is connected to a plurality of circumferentially spaced propellers via a hub.

11 Claims, 2 Drawing Figures

PROPELLER BEARING

BACKGROUND OF THE INVENTION

This invention relates to a new and improved propeller clutch bearing for use with a rotating propeller shaft.

Prior art discloses the use of bearings in combination with seals to support a propeller shaft for use in water. These combinations may employ a bearing that has a plurality of circumferentially spaced staves which engage the propeller shaft for maintaining support only. The present invention is directed to a bearing unit that provides support for the propeller shaft and also permits the interruption of rotation of the propeller while the drive shaft to the propeller continues to rotate as where the propeller should strike an object and is prevented from rotating. Ordinarily under these circumstances, either the propeller blades are broken or the engine will stall out thereby interrupting the power to the propeller, thus preventing the propeller from damages. In this latter instance, generally sufficient damage is done to the propeller to thereby make the interruption in power a meaningless operation. A further feature of the present invention is that in addition to protecting the propeller, the bearing unit itself is also protected from damage. Such action is assured by a unique construction in the bearing member, which employs a rubber-TEFLON interface which because of the rubber member being in compression allows the unit to drive as well as slip under certain conditions of torque. The bearing unit employs an annular rubber torsion type member wherein the torque applied to the drive shaft is transferred to the annular rubber member which winds up as a rubber torsion spring to impart rotation to a sleeve and the hub of a propeller. The rubber torsion member is an elongated flat annular ring which provides contact over a large circumferential area to transmit the load through the bearing unit as it is maintained in its axially aligned position by guide means.

SUMMARY OF THE INVENTION

The present invention provides a novel solution to the problem of preventing damage to a propeller unit while simultaneously permitting the rotation of the propeller drive shaft. The propeller bearing permits incremental deflection of the drive shaft as well as interruption of the shafts rotation without damage to the impeller or marine propeller when the impeller is prevented from rotation even though power input is applied to the propeller drive shaft. The propeller bearing has a splined sleeve that is rigidly connected to the propeller shaft, with the exterior circumferential surface of such sleeve being bonded to an annular rubber member. The annular rubber member, which is in compression, in turn has its exterior surface in frictional contact with the interior surface of a plastic sleeve which is cemented to the interior bore surface of a housing or bushing of the propeller. The annular rubber member is compressed prior to its mounting within the plastic sleeve.

DETAILED DESCRIPTION

Figure 1:
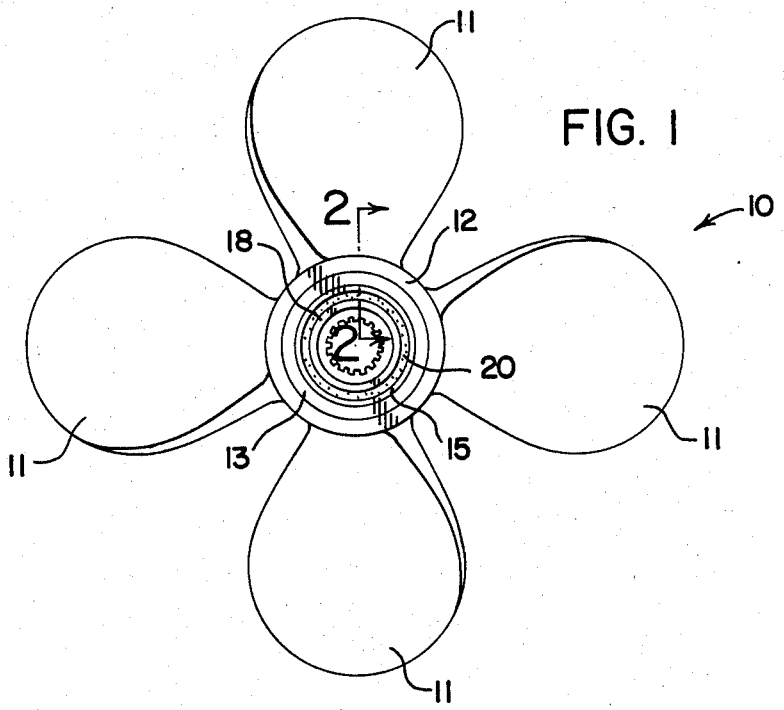
FIG. 1 is a front elevational view of a propeller and propeller bearing.

Referring to the drawings wherein like reference numerals designate like or corresponding parts throughout the several views, there is shown in FIG. 1 a ship's or boat's propeller 10 having a plurality of blades 11 extending radially outward from a circular or annular hub or propeller housing 12. The propeller 10 and propeller housing 12 are suitably connected as by a keyway to a sleeve 13. Sleeve 13 has an annular flanged portion 14 on one end thereof. The exterior circumferentially extending surface of an annular or cylindrical rigid member 15 made of an antifriction material of the type known as polytretrafloroethylene or polychlorotrifluorethylene, also known by the tradename TEFLON bonded to the interior circumferentially extending surface of the sleeve 13. The one end of annular rigid "TEFLON" member 15 is positioned adjacent to the flanged portion 14 of sleeve 13.

Figure 2:
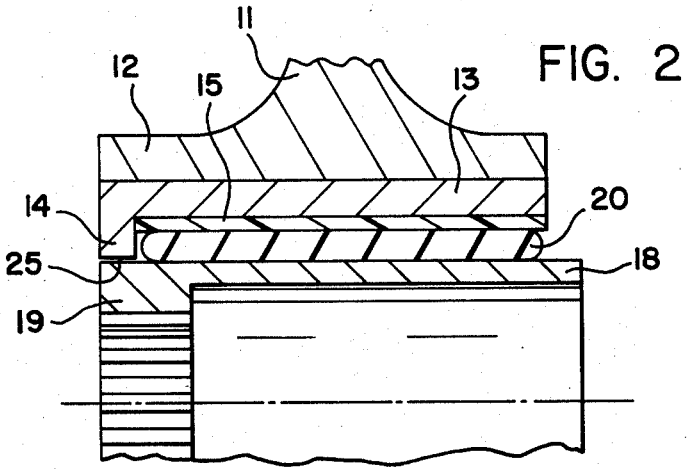
FIG. 2 is an enlarged fragmentary cross-sectional view taken of the propeller bearing on lines 2—2 of FIG. 1.

The drive means for the propeller includes a splined shaft that is connected to a suitable power source not shown and to a rigid bushing 18. Bushing 18 has a flanged cylindrical portion 19 whose inner circumferential surface is splined to facilitate its connection to such drive means of the splined shaft of the drive means mentioned above. In lieu of the splined connection, bushing 18 may be provided with a keyway with which such rigid bushing 18 may be connected to a drive shaft of the power source. Suitably bonded to the exterior circumferentially extending surface of the bushing 18 is a longitudinally extending annular member or ring 20 made of a suitable elastomeric material, which material is operative in sea water without deleterious effects. An elastomer is defined as a substance that can be stretched at room temperatures to at least twice its original length and, returns with force to approximately its original length in a short time. (See Glossary of Terms as prepared by ASTM Committee D11 on Rubber and Rubberlike Materials. Published by the American Society for Testing Materials). Such elastomeric material may be made from a suitable natural, synthetic rubber or a rubber having a combination of these materials that can be vulcanized. The elastomeric material should have adequate resiliency, strength and heat resistance as well as to be able to withstand compressive stresses and torsion strain shear. The elastomeric or rubber materials used in constructing the elastomeric ring or bushing 20 can be any of the well-known elastomers, including for example natural rubber, copolymers of butadiene and acrylonitrile, copolymers of butadiene and styrene, copolymers of butadiene and alkyl acrylates, butyl rubber, olefin rubbers such as ethylene-propylene and EPDM rubber, fluocarbon rubbers, fluorsilicone rubbers, silicone rubbers, chlorosulfonated polyethylene, polyacrylates, polybutadiene, polychloroprene and the like. Annular member 20 as shown in FIG. 2 is in compression, which condition is achieved by first assembling the bushing 18 and the annular elastomeric member 20. The elastomeric member or ring 20 in the compressed condition is 30 to 40 percent of the thickness of the ring in its free uncompressed condition. Thereafter such sub assembly is pressed into the outer sleeve's bore into frictional contact with the inner face of TEFLON member 15. In the compressed condition of elastomeric member or ring 20, the axial length of the ring 20 is over four times the thickness of the ring 20 as shown in FIG. 2.

The one end of annular elastomeric member 20 in its compressed condition is closely adjacent to the flanged portion 14 of sleeve 13 such that the flanged portion has a circumferentially extending surface 25 that is adapted to frictionally contact the outer adjacent surface of bushing 18 in the event that there is an uneven torque applied by a drive shaft to bushing 18. Thus the annular flanged portion 14 of sleeve 13 acts as a guide member to maintain the alignment of the bushing 18 relative to the sleeve 13 and the propeller 10 and propeller housing 12. This action stabilizes the rotation of the propeller.

In the operation of the propeller in the described bearing assembly, a torque is applied by a drive shaft that is splined or keyed to the rigid bushing 18 and imparts a rotation thereto. The annular rubber member or ring 20 which is in compression and bonded to bushing 18, winds up as a rubber torsion spring to an angle less than 15° and imparts rotation to the sleeve 13 which in turn rotates the propeller 10 and the propeller housing 12 to which such sleeve 13 is keyed. In the event the propeller blades 11 strike an object which prevent their rotation, relative rotation occurs between the rubber ring 20 and the sleeve 13 with the rubber ring 20 sliding on the surface of TEFLON cylindrical rigid member 15. The torque at slippage is approximately fifty percent higher than maximum torque delivered to the propeller by the engine or gear transmission.

Various modifications are contemplated and may obviously be resorted to by those skilled in the art without departing from the described invention, as hereinafter defined by the appended claims, as only a preferred embodiment thereof has been disclosed.

I claim:

1. A bearing assembly for a rotating marine propeller comprising:

a rigid bushing having a splined inner bore for connection to a drive shaft, an annular elastomeric member having its inner bore surface bonded to the exterior surface of said rigid bushing for rotation therewith, said annular elastomeric member being in radial compression, said annular elastomeric member being in a flat elongated configuration in cross section, said annular elastomeric member having an exterior circumferentially extending surface in frictional engagement with the interior circumferentially extending surface of a cylindrical rigid member, said cylindrical rigid member is made of an antifrictional material, the outer surface of said cylindrical rigid member is bonded to the interior surface of a sleeve, and said sleeve being securely connected to a circular hub member which has a plurality of blades extending radially therefrom to form said propeller.

2. A bearing assembly as set forth in claim 1 wherein said elastomeric member is made from a vulcanized elastomeric material and said antifrictional material is chosen from the group consisting of polytretrafloroethylene or polychlorotrifluorethylene.

3. A bearing assemlby as set forth in claim 1 wherein said sleeve has guide means thereon for maintaining the alignment of said propeller and said sleeve on said bushing.

4. A bearing assembly as set forth in claim 1 wherein said sleeve has a cylindrical flange which circumferentially encompasses a portion of said rigid bushing for circumferential contact therewith to maintain alignment of said propeller and said sleeve relative to said bushing.

5. A bearing assembly as set forth in claim 4 wherein said radial compression of said annular elastomeric member is thirty to forty percent of the thickness in the free uncompressed condition.

6. A bearing assembly as set forth in claim 5 wherein slippage occurs between said annular elastomeric member and said cylindrical rigid member where the torque is fifty percent higher than the maximum torque delivered to the propeller by said drive shaft.

7. A bearing assembly for a continuously rotating propeller comprising, a pair of cylindrical rigid members disposed in concentric relationship having juxtaposed cylindrical surfaces radially spaced, drive means operatively connected to one of said members for rotating said one member, output means connected to the other one of said members for rotation thereby, an antifriction sleeve secured to one of said cylindrical surfaces, and an elongated annular member of elastically deformable material having inner and outer concentric surfaces one of which is bonded to the other of said cylindrical surfaces, the other one of said surfaces of said elastically deformable annular member frictionally engaging said antifriction material in radial compression whereby said deformable annular member transmits rotation to said propeller while relative rotation of said rigid members is effected when a predetermined maximum force is exceeded due to blockage of rotation of said propeller so that elastic deformation of said deformable annular member occurs as circumferential movement of said deformable member over said antifriction material.

8. A bearing assembly as set forth in claim 7 wherein said relative rotation of said propeller relative to said deformable member occurs when the torque is about fifty percent higher than maximum torque delivered to said propeller by said drive means.

9. A bearing assembly as set forth in claim 8 wherein said guide means is secured to said one cylindrical rigid member to maintain alignment of said other cylindrical member during rotation of said propeller.

10. A bearing assembly as set forth in claim 9 wherein said annular deformable member is made of vulcanized elastomeric material and said antifrictional material is chosen from the group consisting of polytretrafloroethylene and polychlorotrifluorethylene.

11. A bearing assembly as set forth in claim 10 wherein said output means is a propeller for rotation by said drive means, and the length of said annular deformable member is at least quadruple the thickness thereof.

* * * * *